US009574410B2

(12) United States Patent
Soertveit et al.

(10) Patent No.: US 9,574,410 B2
(45) Date of Patent: Feb. 21, 2017

(54) METHOD AND AN APPARATUS FOR RIGGING UP INTERVENTION EQUIPMENT IN A LIFTING ARRANGEMENT UTILIZED ON A FLOATING VESSEL

(71) Applicant: Wellpartner Products AS, Tananger (NO)

(72) Inventors: Haavar Soertveit, Hommersaak (NO); Harald Wahl Breivik, Skedsmokorset (NO); Kenneth Skinnes, Stavanger (NO); Kjetil Samuelsen, Roeyneberg (NO)

(73) Assignee: WELLPARTNER AS, Tananger (NO)

( * ) Notice: Subject to any disclaimer, the term of this patent is extended or adjusted under 35 U.S.C. 154(b) by 0 days.

(21) Appl. No.: 14/361,847

(22) PCT Filed: Nov. 29, 2012

(86) PCT No.: PCT/NO2012/050240
§ 371 (c)(1),
(2) Date: May 30, 2014

(87) PCT Pub. No.: WO2013/081468
PCT Pub. Date: Jun. 6, 2013

(65) Prior Publication Data

US 2014/0308105 A1 Oct. 16, 2014

Related U.S. Application Data

(60) Provisional application No. 61/565,891, filed on Dec. 1, 2011.

(30) Foreign Application Priority Data

Dec. 1, 2011 (NO) ..... 20111659

(51) Int. Cl.
*E21B 19/02* (2006.01)
*E21B 19/22* (2006.01)
*E21B 19/00* (2006.01)

(52) U.S. Cl.
CPC ..... *E21B 19/002* (2013.01); *E21B 19/006* (2013.01); *E21B 19/02* (2013.01); *E21B 19/22* (2013.01)

(58) Field of Classification Search
CPC ..... E21B 19/002; E21B 19/006; E21B 19/02; E21B 19/22
(Continued)

(56) References Cited

U.S. PATENT DOCUMENTS 6,000,480 A * 12/1999 Eik ..... 175/8
7,073,592 B2 * 7/2006 Polsky et al. ..... 166/360
(Continued)

FOREIGN PATENT DOCUMENTS

GB 2418684 A 4/2006
WO WO 2011065836 A1 * 6/2011

OTHER PUBLICATIONS

International Search Report and Written Opinion dated Feb. 22, 2013 (PCT/NO2012/050240).

*Primary Examiner* — Matthew R Buck
(74) *Attorney, Agent, or Firm* — Alix, Yale & Ristas, LLP

(57) ABSTRACT

A method and an apparatus for rigging up intervention equipment (111) in a lifting arrangement (104) utilized on a floating vessel, and moving the intervention equipment between an inoperative and an operative position, wherein the method comprising: a) providing the lifting arrangement (104) with vertically extending guiding means (203) capable of transferring a load to the lifting arrangement; b) connecting a load transferring means (215) to the guiding means
(Continued)

(203); c) connecting the intervention equipment (111) to a load carrying device (209) provided with displacement means (214) arranged in a manner allowing a load to be horizontally displaced while carried by the load carrying device; d) connecting the load carrying device (209) to the load transferring means (215); e) moving the intervention equipment from an inactive position to an operating position by moving the displacement means (214); and f) moving the intervention equipment from the operating position to the inactive position by moving the displacement means (214).

12 Claims, 16 Drawing Sheets

(58) Field of Classification Search
USPC ..... 166/352, 77.1, 77.2; 414/592, 814
See application file for complete search history.

(56) References Cited

U.S. PATENT DOCUMENTS

| | | | | |
|---|---|---|---|---|
| 7,096,963 | B2 * | 8/2006 | Moncus et al. | 166/381 |
| 7,306,404 | B2 * | 12/2007 | Torgersen | 405/224.4 |
| 7,360,589 | B2 * | 4/2008 | Moncus et al. | 166/77.51 |
| 7,640,999 | B2 * | 1/2010 | Patton | 175/57 |
| 7,784,546 | B2 * | 8/2010 | Patton | 166/355 |
| 7,789,155 | B2 * | 9/2010 | Moncus | E21B 19/22 166/313 |
| 8,162,062 | B1 * | 4/2012 | Barone et al. | 166/355 |
| 8,511,385 | B2 * | 8/2013 | Sorenson et al. | 166/339 |
| 8,672,039 | B2 * | 3/2014 | Miller et al. | 166/350 |
| 2001/0025727 | A1 * | 10/2001 | Byrt et al. | 175/7 |
| 2011/0067887 | A1 | 3/2011 | Moncus et al. | |
| 2012/0318530 | A1 * | 12/2012 | Wollum et al. | 166/379 |

* cited by examiner

METHOD AND AN APPARATUS FOR RIGGING UP INTERVENTION EQUIPMENT IN A LIFTING ARRANGEMENT UTILIZED ON A FLOATING VESSEL

BACKGROUND

The disclosure regards a system and a method capable of functioning as an apparatus for transport and handling of equipment in a lifting arrangement used on a floating vessel. More precisely, the disclosure regards a method and an apparatus for rigging up intervention equipment in a lifting arrangement utilized on a floating vessel, and moving the intervention equipment between an inoperative and an operative position.

Offshore subsea wells are typically developed using floating vessels to accommodate equipment, personnel, and operations necessary to drill and complete a well in order to initiate production of hydrocarbons from a given reservoir forming the target for the well. Additionally, testing and intervention work is typically executed through the use of such floating vessels. It is to be understood, however, that such a floating vessel also could be used in context of other types of subsea wells, for example water or gas injection wells.

It is understood that a floating vessel will be subjected to vertical and horizontal (pitch and roll) movement due to the action of the natural environment such as wind and the waves of the sea (or a lake), which in turn introduces a challenge with respect to equipment utilized during operations carried out on the floating vessel. Such operations may include, but are not limited to drilling, completion, well testing, and well intervention. During operation at sea, said equipment will be subjected to vertical movement unless compensated for such movement.

As a floating vessel moves up and down in response to the waves, e.g. a drill string and a drill bit extending down below the vessel from a load-bearing structure, such as a top drive located within a drilling rig, will also move up and down. As it is essential that the weight on the drill bit, i.e. the downward force applied to the bit, is kept as constant as possible, such up and down movements of the drill bit are undesirable and provide for inefficient drilling progress which is counterproductive. Heave will remove weight from the drill bit as the rig moves up in conjunction with the high crest of a wave, while weight will be added to the drill bit as the rig moves down into the low point between two waves. Should hydrocarbons start to flow from a reservoir and into a wellbore being drilled, a valve arrangement is utilized to prevent such hydrocarbons from discharging into the natural environment and onto the floating drilling vessel. Such a valve arrangement is commonly referred to as a Blow Out Preventer (BOP), which is capable of sealing around, or cutting and sealing above, a drill pipe cut by shear rams in the BOP.

In other operations, which may include well testing and well intervention, e.g. wireline operations and coiled tubing operations, several sections of a high pressure tubular, commonly referred to as workover riser, are connected between equipment located at the seafloor, such as a subsea wellhead or a subsea Christmas tree, and the floating drilling vessel. The workover riser provides a barrier element for allowing control of pressurized hydrocarbon fluids present in the reservoir, and hence in the wellbore. A subsea valve arrangement, such as a subsea BOP, is also utilized in such operations to provide a system capable of sealing the well in case of an uncontrolled discharge of hydrocarbons from the reservoir. During such operations, hydrocarbon fluids may be present throughout the wellbore and the workover riser, and discharge at surface rig level is typically prevented by means of a valve arrangement located at the surface, commonly referred to as a surface flow tree. A surface flow tree, or similar equipment attached to a workover riser, extending upwards from equipment located on the seafloor to the rig, is usually supported by, and kept in tension by, the top drive and drawworks forming part of the drilling rig on a floating drilling vessel. Various types of lifting arrangements are utilized to connect the surface flow tree to the top drive and to hold the workover riser in tension as required to prevent high loads from acting on the equipment on the seafloor. Such lifting arrangements may include, but are not limited to, rigid bails, tension frames, soft slings, and backup heave compensation systems. A backup heave compensation system is disclosed in U.S. provisional application Ser. No. 61/480,239 and is referenced herein for informative purposes.

Well completion involves the use of production tubulars, which typically extend downwards from the wellhead and the Christmas tree to the producing zones bound by the reservoir(s) targeted by the well(s). Some parts of a completion operation will require equipment to be in tension in a manner similar to that described above. This may comprise setting the upper lock and seal mechanism of the production tubular, commonly referred to as a tubing hanger, inside the well-head. At this point, a landing string, which is typically made up of several sections of tubular, such as drill pipe or workover riser, will be connected to said tubing hanger at the wellhead and to the top drive at the floating drilling vessel via said lifting equipment. Similar to the description above, the weight of the system is controlled by holding said landing string in tension, thereby maintaining a known force at the level of said tubing hanger.

In operations requiring coiled tubing it is necessary, as mentioned above, to utilize a lifting arrangement capable of maintaining tension in the tubular extending from the wellhead to the floating vessel, such as a workover riser system, to prevent high loads from acting on the equipment on the seafloor. The lifting arrangement must be of a size such that coiled tubing equipment, such as a coiled tubing BOP, coiled tubing dual stripper arrangement and coiled tubing injector head, can be fitted and supported within the lifting arrangement. Furthermore, it is beneficial and in some instances a requirement that the coiled tubing equipment is transported to and from the lifting arrangement by means of lifting devices such as winches and/or hoists integrated in the lifting arrangement. Based on this, it is common practice to utilize tension frames with integrated lifting devices to accommodate for coiled tubing equipment required to execute said operations. The complexity of such tension frames are continuously evolving with respect to functionality integrated in such frames. Such functionality may include but is not limited to lifting devices, such as winches and hoists, manipulator devices utilized to guide equipment being lifted, advanced platform devices comprising means for vertical and horizontal adjustment of equipment such as the coiled tubing injector head, and adjustable work platform devices to accommodate for risk reducing measures during operational sequences and maintenance of equipment. Additional functionality is not merely advantageous as complexity and weight increases, and in some situations limits overall applicability of a tension frame due to said complexity and amount and severity of handling operations required to rig up the tension frame and furthermore change from one mode to another, such as to change from a coiled tubing mode to a wireline mode. Additionally, complex and time consuming operations are required onshore to prepare such tension frames for coiled tubing mode. In situations requiring coiled tubing capability on a floating vessel it is normally, as a minimum, required to utilize wireline equipment prior and after the coiled tubing intervention, hence it is required to alternate between wireline and coiled tubing modes several times. Based on this, it is commonly understood that the added functionality described above introduces disadvantages and increases the risk to personnel and equipment during intervention operations executed by means of tension frames, coiled tubing equipment, and wireline equipment.

In accordance with prior art intervention operations, such as for wireline and coiled tubing operations are executed by means of an intervention frame, such as a coiled tubing tension frame. The tension frame is utilized as a lifting arrangement connected to a load bearing unit in top, such as a top drive, and a surface valve arrangement in bottom, such as a surface flow tree or wireline adapter, further connected to a tubular, such as a workover riser or drilling tubular, extending from the floating vessel to equipment located on the seafloor. Hence, the tension frame and top drive is organized in a manner to hold the weight of said surface flow tree and said tubular, and furthermore ensure that the tubular is in tension to prevent high loads from acting on the equipment on the seafloor. In early configurations of such tension frames, it was common that one lifting device, such as a winch or hoist, was included in a top load bearing member, such as a beam, of the tension frame, which in turn was utilized to lift intervention devices, such as coiled tubing BOP and injector head, from a deck to the tension frame and landed onto a tubular member, such as a x-over/adapter, extending from a said surface flow tree or wireline adapter into the tension frame and also in reverse order in conjunction with removing the coiled tubing equipment from the workover riser stack and tension frame to be landed back onto the deck. The x-over/adapter extending from said surface flow tree or wireline adapter is commonly utilized as the mechanical interface towards a lower load bearing member, such as a beam arranged with such an mechanical interface, of the tension frame such that all forces are maintained by this said mechanical interface.

During recent years several intervention frame concepts have evolved, comprising more advanced functionality related to handling of intervention devices, such as coiled tubing BOP and injector head. These more advanced tension frames typically comprise two or more handling winches/hoists attached to a top load bearing member, such as a top beam, an injector head handling apparatus, such as a platform apparatus, attached to at least two parallel guides, such as tension frame legs, forming a substantially vertical tensioning frame, a manipulator device, adjustable work platform devices, and a lower load bearing member, such as a beam, with an integrated mechanical interface towards a tubular such as a x-over/adapter, extending from a said surface flow tree or wireline adapter into the tension frame. The winches/hoists are typically split into various categories with respect to rated specifications, where a large version winch/hoist is utilized to lift the coiled tubing BOP and injector head into/out of the frame during rigging, while smaller winches/hoists are utilized to handle and rig up smaller equipment such as devices dedicated for purposes of the work in a well, such as bottom hole assemblies used for the actual operation in a well. The platform apparatus defines a landing point for a coiled tubing injector during rigup, whereupon after landing the injector head is moved horizontally and vertically by means of functionality part of the platform apparatus and/or said tension frame. The manipulator device is included to function as a guide to prevent loads hanging from winches/hoists from moving during handling. Adjustable work platforms are included to ensure safe working areas for personnel during operation and maintenance of equipment that is part of the intervention operation executed by means of the intervention frame and intervention devices described herein.

Despite of having some advantages, the recent technological evolvements related to coiled tubing tension frames introduce several disadvantages. The platform apparatus mentioned above requires hydraulic and/or mechanical systems to enable horizontal and vertical movement from a remote location. This functionality comprises several moving and fixed devices which add weight and complexity to the total system during handling, and additional control functions and related hydraulic conduits and/or electric conduits must be part of the tension frame during handling. Additionally, since the platform apparatus is a part of the tension frame prior to lifting intervention devices, such as a coiled tubing injector head, it is necessary to lift the injector head to a certain height prior to moving the load towards center to ensure clearance between the injector head and said platform apparatus prior to landing the injector head onto the platform apparatus, which in turn impose a large working angle onto the winch/hoist wire/chain during handling. Furthermore, the platform apparatus introduces a large sized piece of equipment which is not required for other intervention operations to be executed, such as wireline work, such that it would be beneficial to remove the platform apparatus prior to executing said wireline operations. However, due to the complexity involved with removing the platform apparatus from the tension frame in a rigged up and hence operational position, it is common to leave this as part of the tension frame during said wireline operations further implying non-optimal working environment during said wirleline operations.

It is commonly accepted that weight and complexity of an intervention frame should be limited to a minimum during handling to reduce risk of failure and consequences related to potential accidental situations.

GB 2 418 684 B discloses an apparatus and a method for protecting against problems associated with handling a coiled tubing injector head within a coiled tubing tension frame. The publication discloses a platform apparatus adapted for connection with an intervention frame, the platform apparatus comprising a supporting member, such that in use, the platform apparatus is connected to the intervention frame and the supporting member is shaped or otherwise adapted to support an intervention tool such as a coiled tubing injector. Thus, it is possible to stow an injector head on the intervention frame during use of the frame for other purposes, such as wireline. The publication further specifies that this apparatus and method will significantly reduce the amount of time required for changeover from coiled tubing intervention to wireline intervention. The publication further specifies that in preferred embodiments, the platform apparatus is rotatably connected to the frame and also comprises a turntable. Preferably the platform apparatus can rotate around the frame in a first direction whilst the turntable apparatus rotates in the opposite direction thus maintaining the direction of any coiled tubing towards a V-door provided in the derrick, regardless of the rotational position of the platform apparatus. The invention describes a method for handling a coiled tubing injector head inside an intervention frame, which in turn can be rotated to the side of the intervention frame to create free space for a wireline operation. However, one skilled in the art will recognize disadvantages and operational limitations as it is disadvantageous to position a large load, as represented by a coiled tubing injector head, on the side of an intervention frame structure, as this will generate an uneven force distribution and related bending moments in an intervention frame subjected to movements as generated by movements of the floating drilling vessel as inflicted by the natural environment. Furthermore, the disclosed apparatus illustrates a system where the platform apparatus is mounted as a part of the intervention frame prior to lifting the injector head, further meaning that it is necessary to lift the injector head to a certain height prior to moving the load towards center to ensure clearance between the injector head and platform apparatus prior to landing the injector head onto the platform apparatus, which in turn impose a large working angle onto the winch/hoist wire/chain used during handling.

Further, NO 322006 (B1)/U.S. Pat. No. 7,306,404 B2 also describes a platform apparatus being part of a handling device for well intervention on a floating vessel. The publications disclose a handling device for well intervention, the handling device being releasably connected, in an operative position, to a riser and to a heave compensator which is arranged to maintain a prescribed tensioning of the riser. The handling device comprising: a lower riser securing device; a substantially vertical tensioning frame provided with at least two parallel guides; a jacking table provided with an upper riser securing device; at least one tension-resistant connection between the tensioning frame and the heave compensator located there-above; the jacking table being movable connected to the at least two parallel guides, at least one of the at least two parallel guides including lifting screws for moving the jacking table along the guides in their, in the position of use, vertical extent, and the jacking table including hydraulic cylinders for moving the upper riser securing device in a horizontal direction along at least one axis of movement. One skilled in the art will recognize that the disclosure describes an intervention frame, such as a tension frame, with a moveable jacking table comprising a device and method for clamping onto a tubular, such as a riser, to function as a method for rigging tubular riser sections within the intervention frame, by means of vertical and horizontal displacement of the jacking table. One skilled in the art will furthermore recognize that the jacking table may function as a landing platform for a coiled tubing injector head, and furthermore provide means for handling said injector head in both vertical and horizontal directions. However, in the same manner as explained for the disclosed publication GB 2 418 684 B, the disclosed apparatus and method in publications NO 322006 (B1)/U.S. Pat. No. 7,306,404 B2 describes a system where the platform apparatus, by means of the jacking table, is mounted as a part of the intervention frame prior to lifting the injector head, further meaning that it is necessary to lift the injector head to a certain height prior to moving the load towards center to ensure clearance between the injector head and platform apparatus prior to landing the injector head onto the platform apparatus, which in turn impose a large working angle onto the winch/hoist wire/chain used during handling.

SUMMARY

The primary objective of the disclosure is to remedy or reduce at least one disadvantage of the prior art, or at least to provide a useful alternative to the prior art.

It is also an objective of the disclosure to provide equipment that simplifies the processes required to install and uninstall intervention devices, such as BOP, stripper arrangements, and injector head utilized during a coiled tubing intervention, for lifting arrangements described herein, such as tension frames and backup heave compensation system as described in U.S. provisional application Ser. No. 61/480,239, and furthermore minimize the weight of such lifting arrangement during handling and rigup. It is also an objective of the disclosure to simplify processes required to alternate between intervention modes, and furthermore facilitate for optimized setup of the lifting arrangement for such modes, such as for example coiled tubing and wireline modes.

The objectives are achieved by means of features disclosed in the following description and in the subsequent claims.

According to the disclosure, equipment comprising components simplifying processes required rigging up coiled tubing equipment in a lifting arrangement such as an intervention frame, such as a tension frame or backup heave compensation system is provided.

In accordance with a first aspect of the present disclosure there is provided a method of rigging up intervention equipment in a lifting arrangement utilized on a floating vessel, and moving the intervention equipment between an inactive position and an operating position, wherein the method comprising:

a) providing the lifting arrangement with vertically extending guiding means capable of transferring a load to the lifting arrangement;

b) connecting a load transferring means to the guiding means;

c) connecting the intervention equipment to a load carrying device provided with displacement means arranged in a manner allowing a load to be horizontally displaced while carried by the load carrying device;

d) connecting the load carrying device to the load transferring means;

e) moving the intervention equipment from an inactive position to an operating position by moving the displacement means; and f) moving the intervention equipment from the operating position to the inactive position by moving the displacement means.

In accordance with a second aspect of the present disclosure there is provided a carrier for bringing an intervention apparatus between an inoperative position and an operative position, the carrier being utilized in a lifting arrangement for operation on a floating vessel, the lifting arrangement being provided with vertically extending guiding means capable of transferring a load to lifting arrangement, wherein the carrier comprising:

load transferring means connected to the guiding means:

a load carrying device capable of carrying the intervention apparatus, the load carrying device being provided with displacement means arranged in a manner allowing a load to be horizontally displaced while carried by the load carrying device, locking means for fixing the load carrying device to the load transferring means.

The drilling vessel comprises a rig structure for carrying out well operations in a sub-sea well, and said rig structure comprises a primary heave compensation system connected to a load-bearing structure, such as a top drive, for supporting a tubular structure connected between the floating drilling vessel and the subsea well. For several types of operations performed in a subsea well the tubular structure is connected to the load bearing structure on the rig, such as a top drive, via a lifting arrangement such as an intervention frame which may be a tension frame or a backup heave compensation type frame as described in U.S. provisional application Ser. No. 61/480,239. For this type of operations, in a subsea well, it is typical to execute wireline and coiled tubing operations, where required equipment for such operations is installed inside the intervention frame. The disclosure herein describes an apparatus for transport and handling of equipment, such as coiled tubing equipment, in a lifting arrangement, such as an intervention frame, used on a floating vessel, providing an overall simplified setup for the intervention frame, which in turn results in safer and more time efficient installation and uninstallation of coiled tubing equipment inside the intervention frame. Further, said apparatus for transport and handling of equipment in a lifting arrangement on a floating vessel comprises:

- a stripper system transportation frame comprising functionality for simplified installation of coiled tubing equipment as described herein; and
- a guide system installable on the intervention frame; and
- a control system for operation of said apparatus.

Yet further, said stripper system transportation frame comprises:

- a rigid bottom frame section comprising a stripper system vertically extending jacking device and a pulling device, such as a coiled tubing stabbing winch; and
- a rigid upper frame section comprising a rotatable horizontally extending transport system for equipment such as a coiled tubing injector head, suspension system, and a guide system locking mechanism;

Yet further, said guide system installable on the intervention frame comprises:

- rigid guides connected to the intervention frame; and
- vertical transport system interfacing towards the guide system locking mechanism, part of the upper rigid frame section being part of the stripper system transport frame, free to move in the longitudinal direction of the rigid guides
- a locking mechanism to secure the vertical transport system in various positions along the rigid guides;

Yet further, said control system comprises:

- components required to operate all functionality of the coiled tubing rigup system
- components required to interface towards other control systems to ensure that the herein disclosure can be exploited in conjunction with any type intervention frame designated for the operations;
- wherein all controllable components are connected to the control system; and
- wherein the control system is structured in a manner allowing it to operated said apparatus for transport and handling of equipment so as to accommodate for operations simplifying processes required to install and uninstall coiled tubing equipment in intervention frames of any type utilized on a floating vessel.

In a preferred embodiment, said apparatus for transport and handling of equipment may comprise the stripper system transportation frame, further comprising the rigid bottom frame section, comprising a stripper system vertically extending jacking device and a pulling device, and the rigid upper frame section comprising a horizontally extending transport system, suspension system, and a guide system locking mechanism, where the rigid upper frame and said rigid bottom frame are locked to one another by means of a locking device, such as for example locking pins. The horizontally extending transport system may also comprise a turntable providing rotatable functionality, to ensure that equipment placed on the horizontally extending transport system, such as a coiled tubing injector head, can be rotated around a vertical axis to ensure a correct orientation of the coiled tubing injector head with respect to other devices such as coiled tubing extending from a coiled tubing reel on the deck to the coiled tubing injector head mounted on the turntable.

Furthermore, the stripper system may be connected to the stripper system vertically extending jacking device and secured therein by means of a mechanical interface which may be a quick connection device normally used to connect a stripper system to a coiled tubing BOP.

Moreover, the embodiment describes the apparatus for transport and handling of equipment in a transport position utilized to transport the apparatus from one location to another, where one location may be an onshore facility, and where another location may be a location on a floating vessel, such as the rig floor.

Further, to a preferred embodiment of the disclosure, said rigid guides may be connected to said lifting arrangement, such as an intervention frame of any type.

Furthermore, said vertical transport system, which may comprise an interface towards the guide system locking mechanism, being part of the upper rigid frame section which is part of the stripper system transport frame, and locking mechanism to secure the vertical transport system in various positions along the rigid guides, may be connected to the rigid guides in a predefined position.

Moreover, the facilitation of the rigid guides and said vertical transport system may be executed in any location, such as in an onshore facility, a floating vessel, or after the lifting arrangement is installed in the rig of a floating vessel.

The vertical transport system is typically split into as many vertical transport systems as the amount of rigid guides as defined by the amount of said tension legs. Alternatively, vertical transport systems may be connected to provide for one such vertical transport system, where the connection method is designed in a manner ensuring that the vertical transport system will not introduce an obstacle to equipment being moved horizontally, such as the stripper system.

In another embodiment of the disclosure, a coiled tubing injector head may be placed on top of the horizontally extending transport system, being part of the rigid upper frame section, which is part of the stripper system transportation frame, where the injector head comprises mechanical interfaces, such as funnels, which in turn match with opposing members, such as pins, being part of the horizontally extending transport system, whereupon the mechanical interface may be secured by means of locking pins.

Furthermore, the stripper system may be disengaged from the mechanical interface in bottom, which may be of a quick connection device normally used to connect a stripper system to a coiled tubing BOP, whereupon the stripper system may be lifted by means of operation of the vertically extending jacking device, such that the upper part of the stripper system may be connected to a predefined mechanical interface being part of the coiled tubing injector head.

Furthermore, the pulling device may be used to stab a coiled tubing into the coiled tubing injector head by means of extending a wire or chain from the pulling device through the inside of the stripper system, through the inside of the coiled tubing injector head, over the gooseneck, part of the injector head, and to the coiled tubing placed on a coiled tubing reel. The coiled tubing reel may be located on the deck of a floating vessel, where the wire or chain is connected to the end of the coiled tubing by means of a connection device, such as a stabbing connector. The pulling device may be used to pull the coiled tubing into the coiled tubing injector head in a controlled manner, whereupon the coiled tubing is engaged inside the coiled tubing injector head, the wire or chain is disengaged from the coiled tubing and stored back onto the pulling device. The coiled tubing may be extended to exit through the stripper system whereupon a securing device is attached to the coiled tubing to ensure that the coiled tubing cannot exit upwards through the stripper system and as such disengage from the coiled tubing injector head.

In a preferred embodiment of the disclosure, a wire or chain extending from a lifting device, such as a winch or hoist, being part of the intervention frame is attached to the lifting sling being part of the coiled tubing BOP, whereupon the coiled tubing BOP is lifted into the intervention frame and connected to the top of the x-over/adapter, extending from a said surface flow tree or wireline adapter into the tension frame by means of a connection device, such as a flanged connection. However, the connection device is not part of the herein disclosure and as such not explained in further detail.

Further to a preferred embodiment of the disclosure, the wire or chain extending from the winch or hoist, part of the intervention frame is attached to the lifting sling being part of the coiled tubing injector head.

Furthermore, the locking device enabling a mechanical lock between the rigid upper frame and said bottom frame, being part of the stripper system transport frame, is disengaged, such that upon lifting the coiled tubing injector head by means of operation of the lifting device part of the intervention frame, the rigid upper frame and said stripper system will be part of the load, whilst the rigid bottom frame will remain on the deck. It should be noted that the rigid upper frame is designed such that in this embodiment, where the stripper system is engaged with the coiled tubing injector head, the bottom part of the stripper system is situated above the bottom part of the upper rigid frame, and as such the load can be placed back onto the deck without engagement with the rigid bottom frame. This feature may be an advantage in terms of a situation requiring to land the load onto the deck without access to the rigid bottom frame, such as for example an emergency situation which may occur due to bad weather, malfunction of critical components, or any other cause.

Moreover, a load, which may be described to comprise the coiled tubing injector head, said rigid upper frame, and said stripper system, is lifted by means of operation of the lifting device part of the intervention frame, where the load is guided by means of operation of at least one lifting device part of the floating vessel rig, such as a tugger winch, engaged to the load by means of installing the wire from the at least one said tugger winch into at least one wire wheel device, such as a sheave wheel, attached to the load, whereupon the load can be guided by means of tension applied to the at least one said tugger winch.

Furthermore, as the load is lifted from the deck towards the intervention frame by means of operation of the lifting device part of the intervention frame, the load is continuously held back from the intervention frame by means of operation of the at least one said tugger winch, whereupon when the load is in correct height the load is guided towards the vertical transport system by means of operation of the at least one said tugger winch, until the load is engaged with the vertical transport system by means of engaging the guide system locking mechanism with the interface part of the vertical transport system. It should be noted that the suspension system may be used to facilitate a controlled engagement of the guide system locking mechanism, to limit movements and related impacts during the process described. From this position it may be necessary to extend the coiled tubing from the injector head to the deck of the floating vessel, where a coiled tubing end connector is connected to the coiled tubing. However, one skilled in the art will recognize that the coiled tubing end connector may be connected at an earlier time depending on the type used, but such devices are not part of the herein disclosure and as such not explained in further detail.

Furthermore to a preferred embodiment, the locking mechanism to secure the vertical transport system in various positions along the rigid guides may be disengaged and as such facilitate for vertical movement of the vertical transport system and hence the load by means of operation of the lifting device part of the intervention frame. Thus, said vertical movement described is executed in a guided manner preventing the load from horizontal movement as may be expected due to movements of the floating vessel as inflicted by the natural environment. Once the load is in a desired position vertically along the rigid guides, the locking mechanism for securing the vertical transport system in various positions along the rigid guides may be engaged. In one possible embodiment, the locking mechanism to secure the vertical transport system in various positions along the rigid guides may be activated and deactivated by means of operation of a device part of the rigid upper frame, further implying that such activation and deactivation devices and its required control conduits need not to be connected to the rigid guides or the vertical transport system.

Further to a preferred embodiment, another lifting device, such as a winch or hoist, being part of the intervention frame may be used to lift devices dedicated for purposes of the work in a well, such as bottom hole assemblies, used for the actual operation in a well, into the top of the coiled tubing BOP attached to the surface flow tree, which is further attached to the workover riser extending to and connected to equipment located on the seafloor, whereupon the bottomhole assembly is secured on top of the BOP by means of equipment normally utilized for this purpose. However, this equipment is not part of the herein disclosure and therefore not explained in further detail.

A bottom hole assembly may comprise several sections where following sections are lifted into and connected to the previous section former secured to the top of the BOP, by utilizing a second lifting device. Once the bottom hole assembly is complete the coiled tubing injector head attached to the stripper system may be horizontally displaced, by means of operation of the horizontally extending transport system, such that the center of the bore of the stripper system will match with the center of the bore of the well as represented by the coiled tubing BOP. Thereafter, the coiled tubing is attached to the bottomhole assembly by means of connecting the bottomhole assembly to the coiled tubing end connector. Thereafter, the locking mechanism for securing the vertical transport system in various positions along the rigid guides may be disengaged and as such facilitate for vertical movement of the vertical transport system. Hence, the coiled tubing injector head and said stripper system is lowered and connected to the coiled tubing BOP by means of operation of the chain or hoist part of the intervention frame. The connection between the coiled tubing BOP and said stripper system may be facilitated by a quick connection device normally used for such connections. At this point the coiled tubing equipment is installed into the intervention frame and operational sequences can be initiated. One skilled in the art will recognize that the above described procedure is reversed in a situation where it is required to uninstall the coiled tubing equipment.

Further to a preferred embodiment, in situations where it may become necessary to change the bottomhole assembly the quick connection is disengaged, whereupon the coiled tubing injector head and said stripper system is lifted by means of operation of the lifting device, part of the intervention frame. Then the locking mechanism to secure the vertical transport system in various positions along the rigid guides may be engaged. Thereafter, the bottomhole assembly is disconnected from the coiled tubing by means of disconnecting the bottomhole assembly from the coiled tubing end connector, whereupon the coiled tubing injector and said stripper system can be horizontally displaced into the rigid upper frame, by means of operation of the horizontally extending transport system. Whereupon, the bottomhole assembly can be lifted from the coiled tubing BOP to the deck of the floating vessel by means of operation of the another lifting device part of the intervention frame. Accordingly, a new bottomhole assembly can be installed in the same manner as explained above for the initial said bottomhole assembly and the injector head and said stripper system is connected to the BOP in the same manner as explained above. It should be noted that the same procedure may be repeated for yet a new bottomhole assembly and so on. It should be noted that one skilled in the art will recognize that the disconnection point may also be below the coiled tubing BOP for the operations described for a preferred embodiment the procedures described for changing from the bottomhole assembly to the new bottomhole assembly, and further for yet a new bottomhole assembly and so on, and as such the coiled tubing BOP would be attached to the stripper system, which in turn is attached to the coiled tubing injector head, which in turn is lifted by the lifting device part of the intervention frame.

In another embodiment of the disclosure, a control system is utilized to operate all functionality of the herein disclosure, further comprising the possibility to operate the functionality of the system from a local control panel and/or from a remote control panel. It should further be noted that the functionality described herein may be by electrical and or mechanical and or hydraulic means.

One skilled in the art will understand that the description of the control system, and also the operation of the lifting arrangement disclosed herein, is based on the use of one control system and method, but that several other control systems and methods can be utilized to achieve the same system functionality.

BRIEF DESCRIPTION OF THE DRAWINGS

The disclosure will now be described by way of non-limiting embodiments, referring also to the accompanying figures, in which.

The figures are somewhat schematic and only depict details and equipment necessary for the understanding of the disclosure. Moreover, the figures may be somewhat distorted with respect to relative dimensions of details and components shown therein. Furthermore, the figures are simplified with respect to the shape and richness in detail of such components and equipment shown therein. Hereinafter, equal, equivalent or corresponding details of the figures will be given substantially the same reference numbers.

Terms "horizontal", "vertical", "upper", "lower", "left", "right" refers to the positions in the figures.

DETAILED DESCRIPTION

Figure 1:
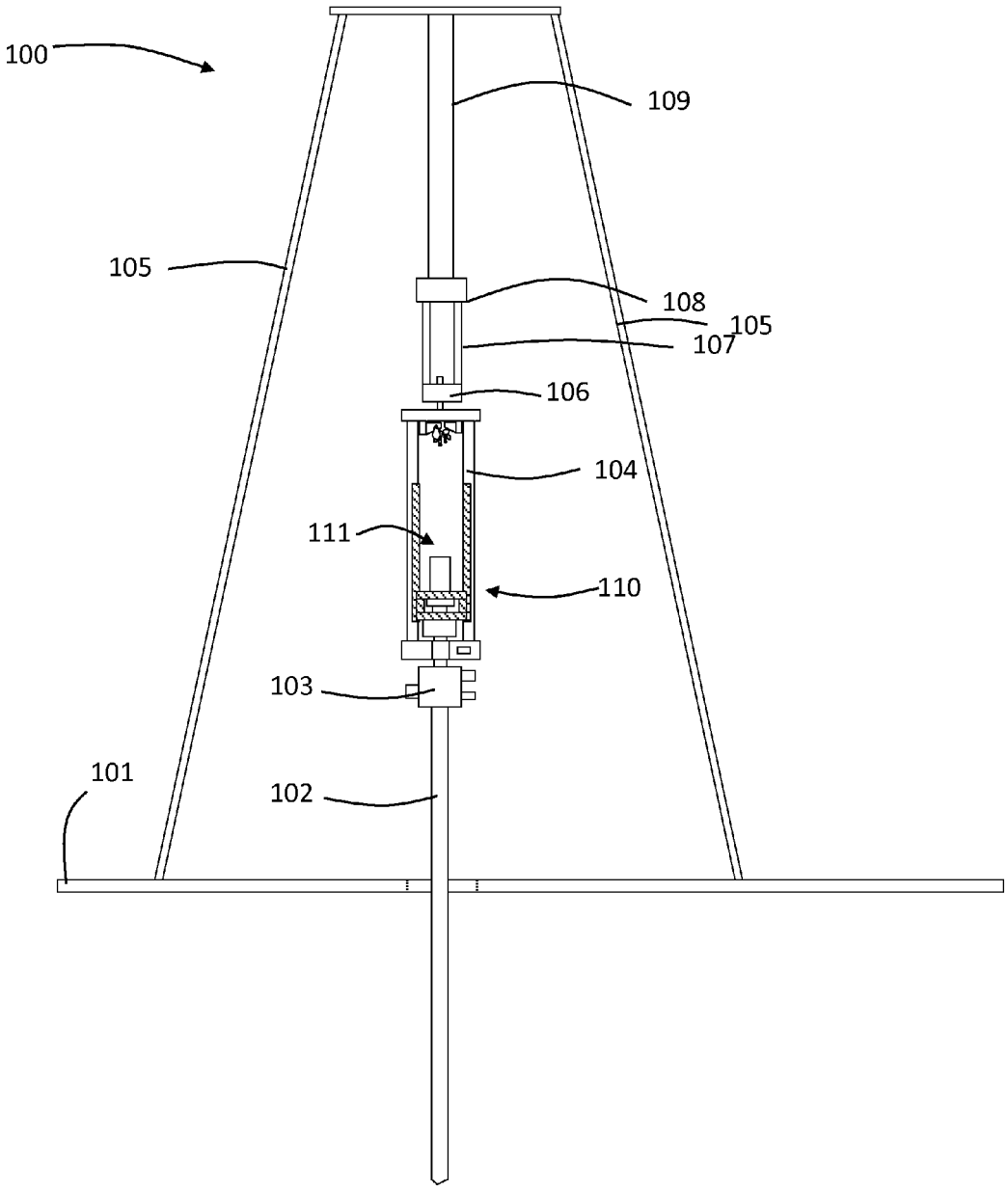
FIG. 1 illustrates a simplified example of one embodiment of the disclosed apparatus.

FIG. 1 illustrates an example of operating according to the disclosed apparatus. A drilling vessel is described only by important components such as a rig floor 101, a drilling rig 105, which further comprise various components 109 as required to operate and move a load-bearing unit, such as a top drive 108, which is further connected to an elevator 106 via rigid bails 107. Various components 109 further comprise a heave compensator as required to compensate vertical movement inflicted onto the drilling vessel by the waves of the sea. The heave compensator ensures that other equipment including top drive 108 and all equipment attached below the top drive 108 is maintained in a stationary position with required tension applied in accordance with accepted force applied to the equipment located on the seafloor, and hence avoid excessive tensional and compressive forces as the drilling vessel moves vertically up and down as a result of waves of the sea. It should be noted that various components 109 are not further explained herein as one skilled in the art will understand various methods, apparatuses and devices that exist to allow for functionality of such various components 109, and further that these various methods, apparatuses and devices will not affect the execution of the herein disclosure. FIG. 1 further illustrates how a tubular such as a workover riser 102 is connected to a surface valve arrangement such as a surface flow tree 103, which in turn is connected to the top drive 108 on the drilling vessel via lifting arrangement 104, such as an intervention frame as described herein. The lower end of the workover riser 102 is connected to equipment on the seafloor further defined as a lock to bottom situation, further meaning that all equipment in the stack comprising the workover riser 102, surface flow tree 103, intervention frame 104, elevator 106, rigid bails 107, top drive 108, and parts of various components 109 are in a stationary mode and hence will not move up and down in relation to the drilling vessel as inflicted by waves of the sea. Due to a heave compensation system part of various components 109, excessive tensional and compressive forces as a result of vertical movement of the drilling vessel will not be inflicted onto the equipment subjected in a stationary mode as described above. To further describe the disclosure herein the intervention equipment 111 is installed into the intervention frame 104 by means of an apparatus for transport and handling of equipment in a lifting arrangement on a floating vessel. The functionality and preferred embodiments of apparatus 110 is further described in relation to FIGS. 2-16.

Figure 2:
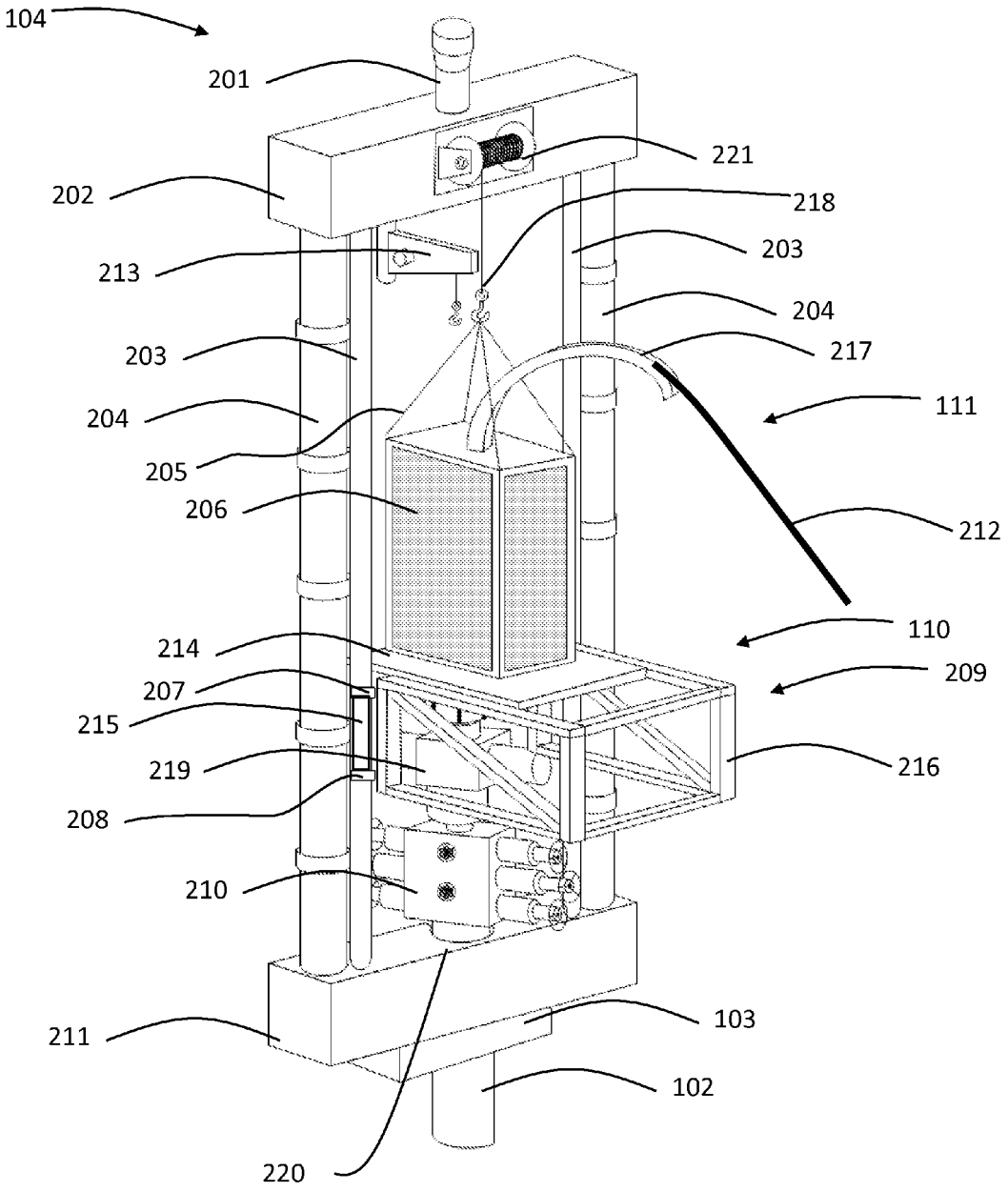
FIG. 2 illustrates examples of preferred general system features for a generalised embodiment of the disclosed apparatus.

FIG. 2 illustrates an operational setting of the disclosed apparatus described herein. In FIG. 2, a possible embodiment of the apparatus is shown, where an intervention frame 104 is illustrated in an operational setting. In the operational setting the intervention frame 104 comprises a top interface sub 201, which facilitates as a connection point towards the elevator 106 (shown in FIG. 1), a top load bearing member 202, typically a beam, a substantially vertical tensioning frame provided with at least two parallel guides, such as tension legs 204, a lower load bearing member 211, typically a beam, which comprise an interface 220 towards a x-over/adapter piece extending from a surface flow tree 103, which in turn is connected to a workover riser 102, extending to equipment located on the seafloor and connected thereto. Further, to the intervention frame 104, lifting devices 221 and 213, typically winches, are attached to the top beam 202. With reference to FIG. 2, the embodiment illustrates coiled tubing equipment 111 installed inside the intervention frame 104, where parts of the coiled tubing equipment 111 is installed and handled by means of an apparatus 110 according to the disclosure. The coiled tubing equipment 111 comprises a coiled tubing BOP 210, connected to the x-over/adapter piece extending from a surface flow tree 103, a stripper system 219 connected to the top of the BOP 210, a coiled tubing injector 206 connected to the top of the stripper system 219, a coiled tubing gooseneck 217 connected to the top of the injector head 206, and coiled tubing 212 extending from a reel located on the deck of the floating vessel via the gooseneck 217, the coiled tubing injector 206, stripper system 219, BOP 210 and into the well via the surface flow tree 103 and workover riser 102, as relevant for an operational setting of the described coiled tubing equipment 111. The apparatus 110 comprises rigid guides 203, which may be mounted to the tension legs 204 or to the top beam 202 and lower beam 211, vertical transport system 215, rigid upper frame section 209, further comprising a rigid frame 216, a horizontally extending transport system 214, and upper and lower guide system locking mechanisms 207 and 208 respectively. The rigid upper frame section 209 is also denoted "a load carrying device" and the vertical transport system 215 is also denoted "a load transferring means". In combination the load carrying device 209 and the load transferring means 215 is said to constitute a carrier which constitutes a second aspect of the disclosure.

Further to the operational setting illustrated in FIG. 2, the weight of the coiled tubing injector head 206, stripper system 219, BOP 210 is directed to the tension frame 104 via the x-over/adapter piece, extending from the surface flow tree 103, which is mechanically attached to the intervention frame by means of the interface 220. A hook and wire assembly 218 extending from the winch 221 is attached to the coiled tubing injector head sling 205 for providing double security. One skilled in the art will recognize that FIG. 2 illustrates one possible embodiment of the described operation and further that components may comprise any form or shape not apparently described in the figure.

Figure 3:
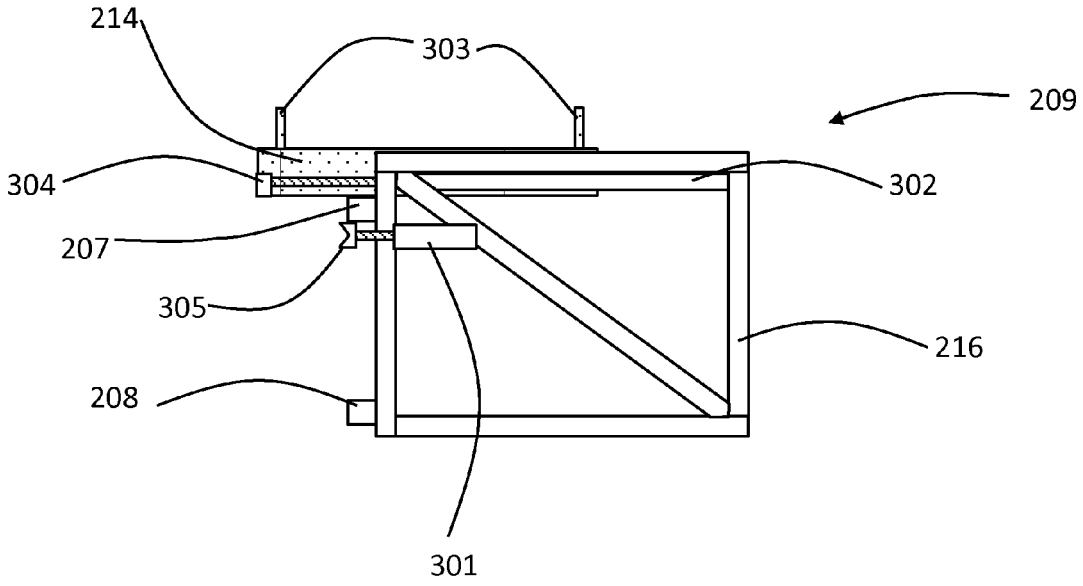
FIG. 3 illustrates a rigid upper frame of the disclosed apparatus.

FIG. 3 illustrates a side view of the rigid upper frame section 209 of the disclosure. The upper frame section 209 comprises: a rigid frame structure 216; a horizontally extending transport system 214; an upper guide system locking mechanism 207; a lower guide system locking mechanism 208; and horizontally extending members 302, such as hydraulic cylinders. In FIG. 3 is also shown a suspension system 301, such as hydraulic dampeners. The suspension system 301 further comprises engagement devices 305 being shaped to ensure a dedicated engagement towards an opposing member such as the rigid guides 203, vertical transport system 215, and tension legs 204 shown in FIG. 2, or any other component which may function as an opposing member for the engagement devices 305. Furthermore, the rigid upper frame section 209 comprises a horizontally extending transport system 214, further comprising guide pins 303, which are designed to interface towards guide funnels being part of the coiled tubing injector 206 shown in FIG. 2. The horizontally extending transport system is attached to the hydraulic cylinders 302 via connecting member 304, and as such horizontal displacement of the transport system 214 is facilitated by operation of cylinders 302. One skilled in the art will recognize that the transport system 214 must be designed in a manner bearing the loads introduced by coiled tubing equipment 111 previously described and further that a load bearing interface is required in the rigid frame 216 to ensure that the forces generated by the loads carried are transferred to the rigid frame 216.

Figure 4:
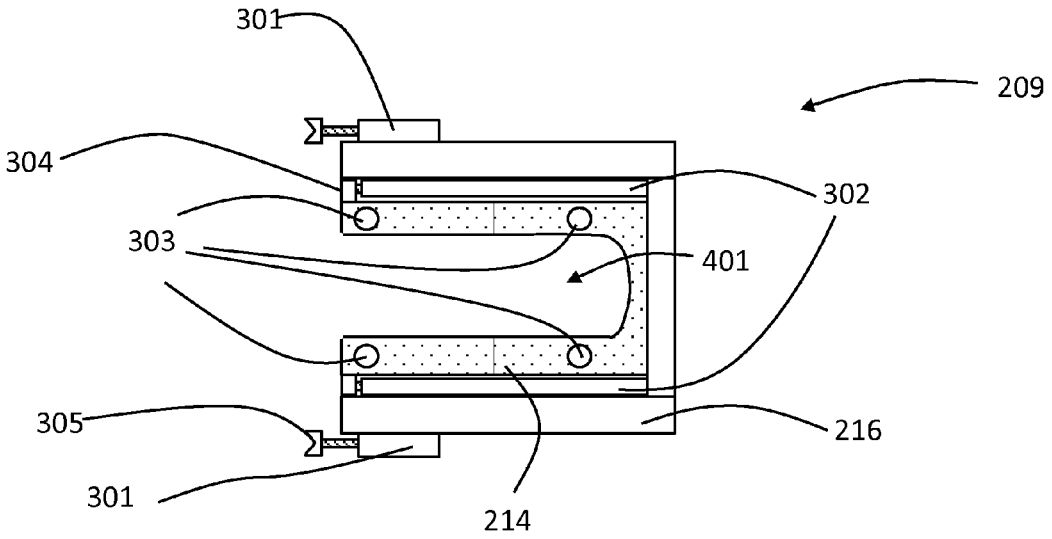
FIG. 4 illustrates a top view of the rigid frame described in relation to FIG. 3.

FIG. 4 illustrates a top view of a rigid upper frame section 209 previously described in relation to FIG. 3. This view further illustrates that the frame 209 is designed in a manner providing an opening 401 to facilitate for horizontal movement of the transport system 214 carrying equipment such as a coiled tubing injector head 206 attached, which in turn is attached to the stripper system 219. It should be noted that the opening 401 is towards the same direction as will be for the intervention frame respective of the rigid upper frame section 216.

Figure 5:
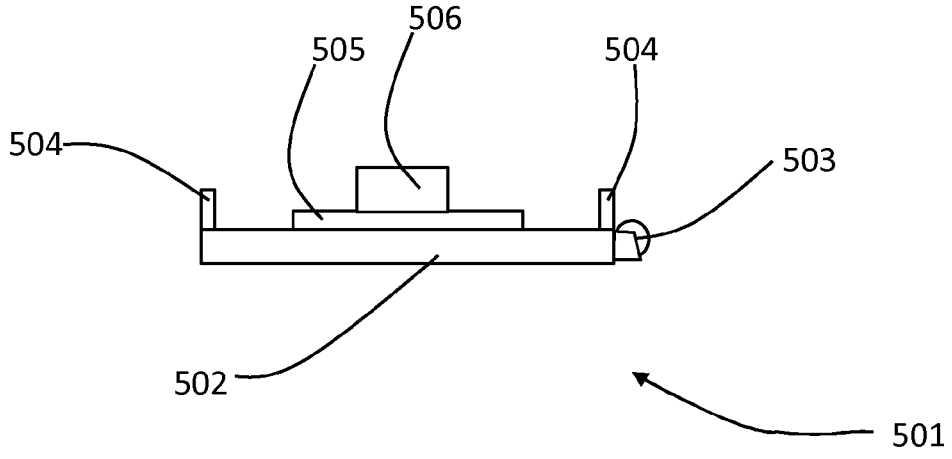
FIG. 5 illustrates a rigid bottom frame of the disclosed apparatus.

FIG. 5 illustrates a rigid lower frame section 501 comprising: a frame 502; guide pins 504, which are designed to interface towards guide funnels part of the rigid frame 216. The frame 501 further comprises a pulling device 503, such as a coiled tubing stabbing winch, a vertically extending jacking device 505 comprising an interface 506 towards a quick connection device typically utilized for connecting a stripper system to a BOP 210, such that a stripper system 219 can be landed and secured onto the vertical extending jacking device 505 by means of the interface 506.

Figure 6:
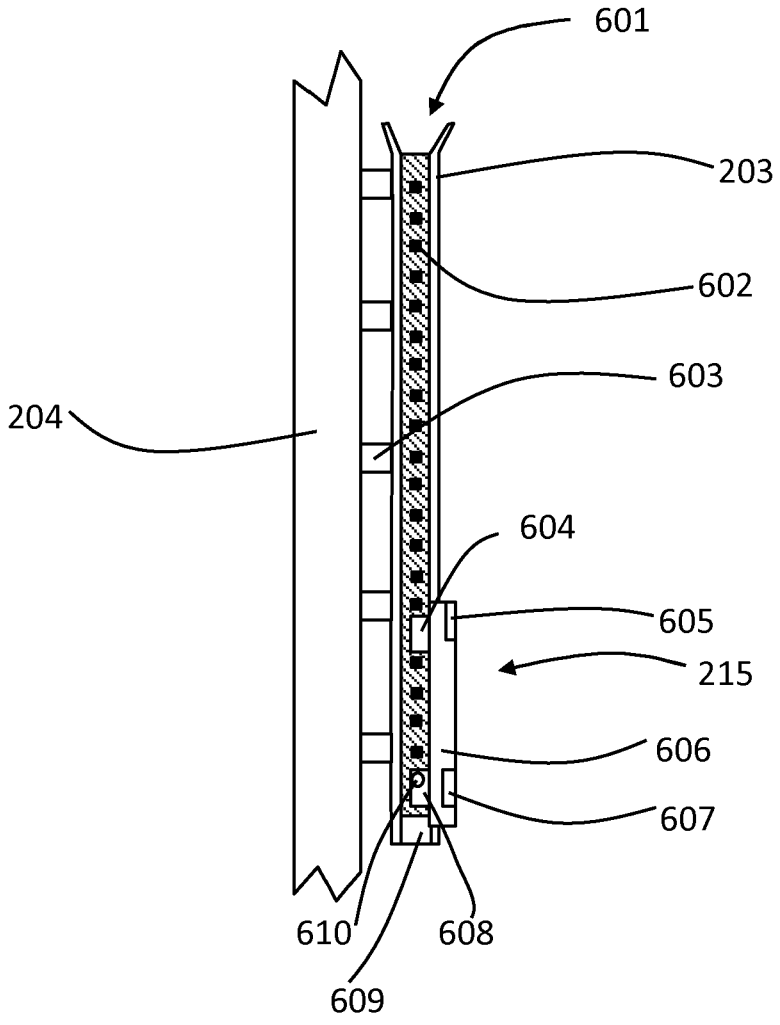
FIG. 6 illustrates a guide system of the disclosed apparatus.

FIG. 6 illustrates one possible embodiment for the rigid guides 203 and the vertical transport system 215 indicated in FIG. 2. For the illustrated embodiment the rigid guide 203 is attached to a tension leg 204 by means of connection interfaces 603, and further comprises: a funnel shaped top portion 601 to accommodate for one possible method of installing the vertical transport system 215; an end stop device 609 to prevent the vertical transport system 215 from exiting in the lower part of the guide 203; locking mechanism interfaces 602 to accommodate for engagement of locking mechanism 610 forming part of the vertical transport system 215. The vertical transport system 215 comprising: a load bearing structure 606; an upper guide system locking mechanism interface 605; a lower guide system locking mechanism interface 607 which interface towards guide system locking mechanisms 207 and 208 part of the rigid upper frame section 209 respectively; an upper low friction guide 604; a lower low friction guide 608, further comprising a locking mechanism 610, which is designed to engage with any of the locking mechanism interfaces 602, and as such facilitate for a possibility to park the vertical transport system 215. Hence, the coiled tubing injector head 206 and stripper system 219, in any position as defined by the locking mechanism interfaces 602 along the length of the rigid guides 203. In FIG. 6, the locking mechanism 610 is illustrated as part of lower low friction guide 608. However, one skilled in the art will recognize that the locking mechanism 610 may be a part of upper low friction guide mechanism 604, rigid guides 203, or other sections of the vertical transport system 215.

FIGS. 7-14 illustrates operational steps utilizing the disclosed method and system described herein.

Figure 7:
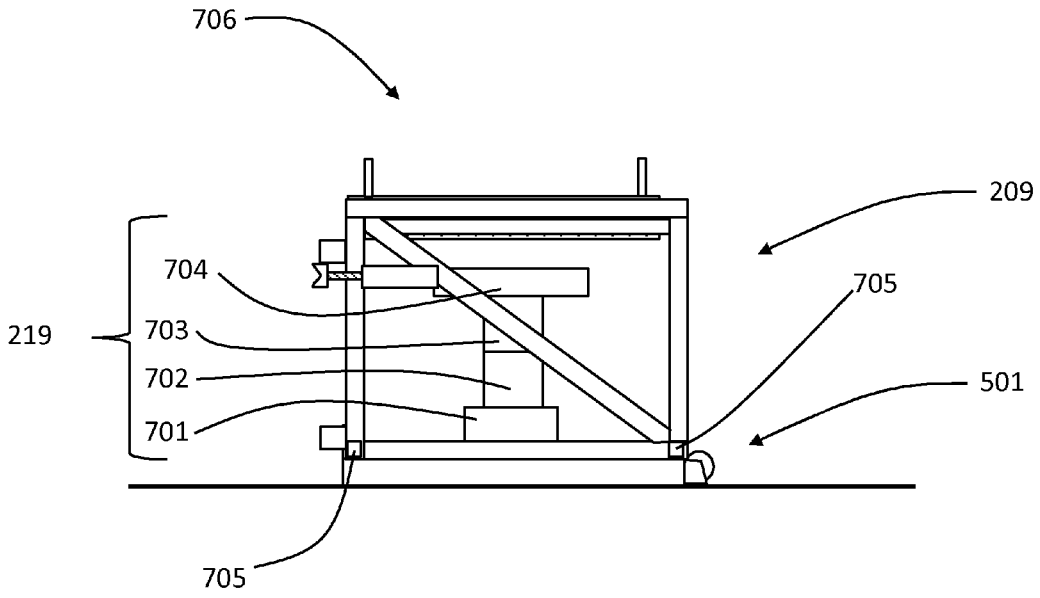
FIG. 7-14 illustrates an operational setting of the disclosed apparatus.

FIG. 7 illustrates a stripper system transport frame 706 comprising: a rigid lower frame section 501, as described in relation to FIG. 5; a rigid upper frame section 209, as described in relation to FIGS. 3 and 4; locking mechanisms 705, utilized to engage the rigid upper frame section 209 to the rigid lower frame section 501; a stripper system 219 comprising: a quick connection device 701 interfacing towards typical quick connection devices utilized to connect a stripper system 219 to a BOP 210; a lower stripper 702; an upper stripper 703; and an injector head interface 704, typically shaped as a drip tray for a coiled tubing injector head 206, and further interfaced towards an injector head 206 by means of locking bolts. The embodiment in FIG. 7 illustrates the stripper system transport frame 706 being utilized as a means for transport the stripper system 219 from one location to another such as for example from an onshore facility to a floating vessel, whereby the stripper system transport frame 706 may be placed on the rigfloor 101 of the floating vessel.

Figure 8:
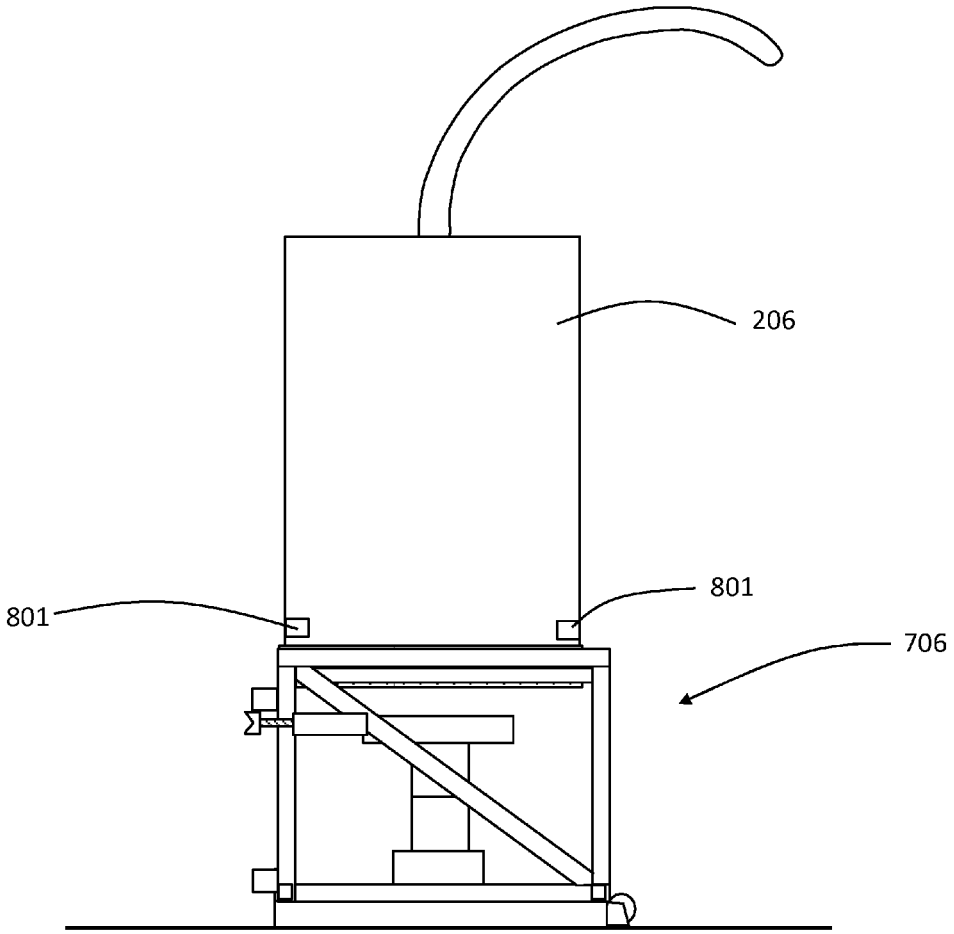

FIG. 8 illustrates the step following placement of the stripper system transport frame 706 in a location on the floating vessel dedicated to installation of the coiled tubing equipment into an intervention frame 104, such as a rigfloor 101. With reference to FIG. 8, a coiled tubing injector head 206 is installed onto the horizontally extending transport system 214, part of a stripper system transport frame 706, by interface between funnels part of the bottom of the injector head frame structure and guide pins 303, whereupon the injector head 206 is locked onto the transport system 214 by means of locking mechanisms 801. One skilled in the art will recognize that the funnels part of the bottom of the injector head frame is commonly utilized for the purpose described herein and hence such functionality is not described in further detail.

Figure 9:
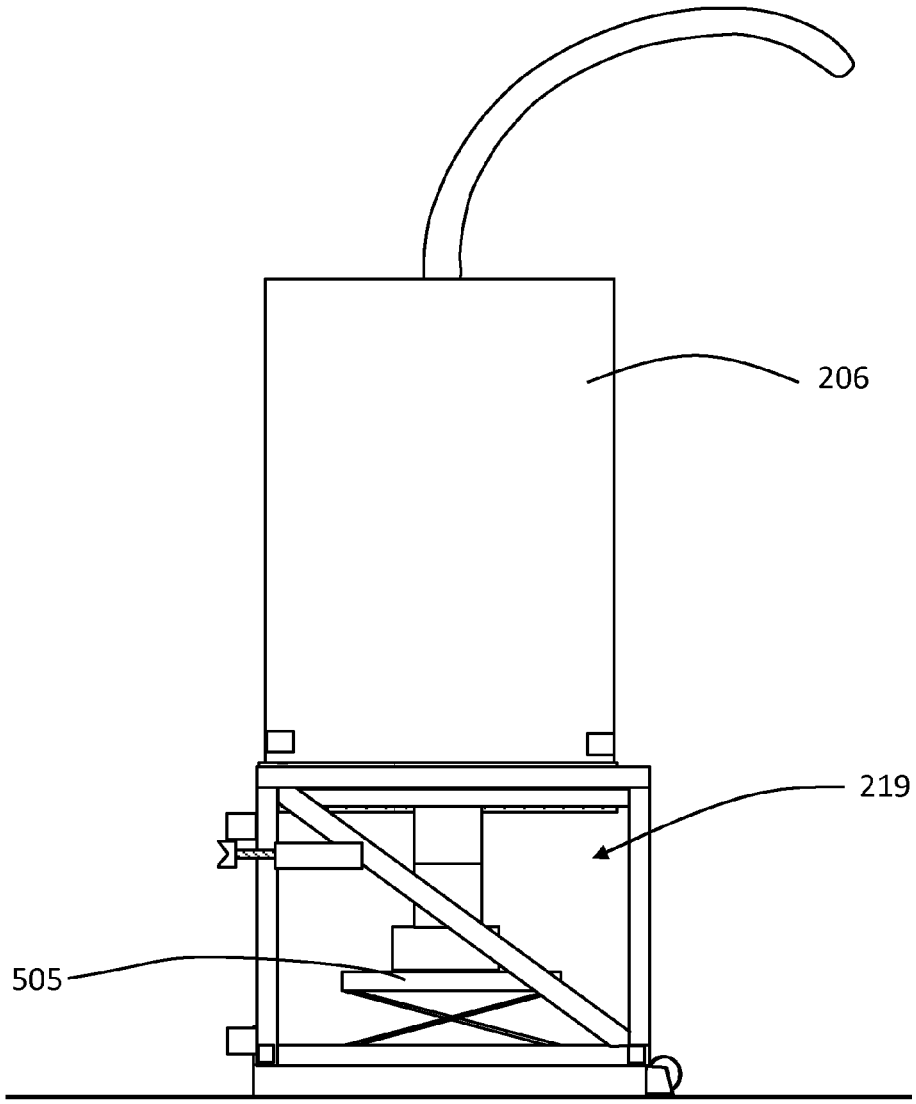

FIG. 9 illustrates the step following placement of the injector head 206 onto the stripper system transport frame 706, where the stripper system 219 is lifted by means of operation of the vertically extending jacking device 505, until the injector head interface 704 can be engaged with opposing part of the injector head 206. The vertically extending jacking device 505 may be operated by means of a mechanical and/or hydraulic and/or electrical operation.

Figure 10:
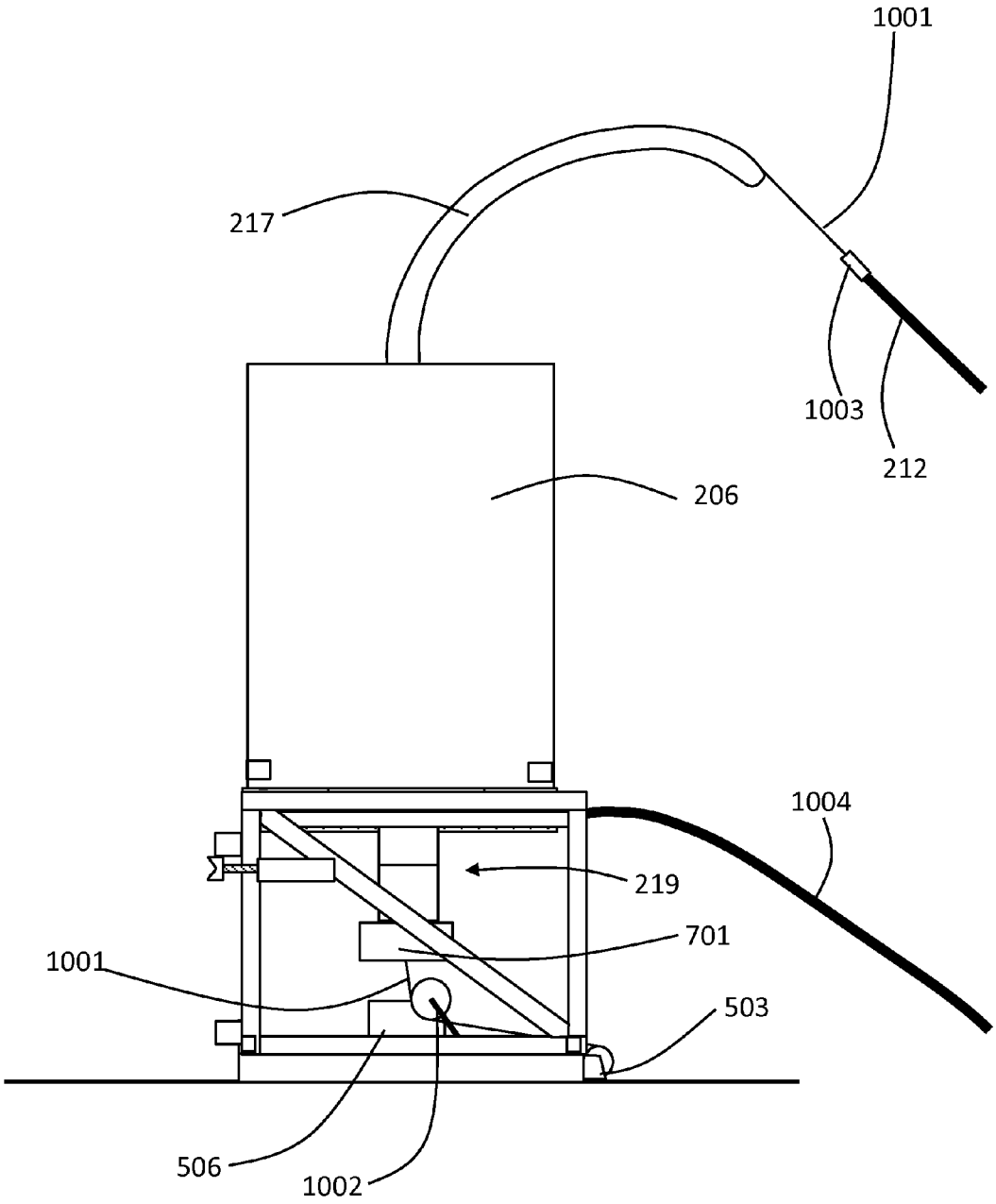

FIG. 10 illustrates the step following engagement of the stripper system 219 towards the injector head 206. For this step the quick connection device 701, which is part of the stripper system 219, is disconnected from the opposing member 506 being part of the vertically extending jacking table 505, which in turn is lowered to create an access window between the two quick connection components 701 and 506 respectively, whereupon a bundle of conduits 1004, comprising conduits for control and monitoring of all functionality related to the coiled tubing injector head 206, stripper system 219, stripper system transport frame 706, and vertical transport system 215, is connected. A wire 1001 is extended from the stabbing winch 503 via a guide 1002, such as a sheave wheel, stripper system 219, injector head 206, gooseneck 217 and down to a coiled tubing reel placed on the deck of the floating vessel, where a pulling connection 1003, such as a stabbing connector is connected to the coiled tubing 212, whereupon the coiled tubing 212 is pulled over the gooseneck 217, and into the injector head 206 and stripper system 219 by means of operation of the stabbing winch 503. It should be noted that one skilled in the art will recognize that the bundle of conduits 1004 may be connected to the injector head 206, and/or rigid upper frame section 209, and/or stripper system 219, or by any practical means, and further that preparation of conduits between components may be executed as practical by means of common practice as related to conduits for control and monitoring of the mentioned functionality.

Figure 11:
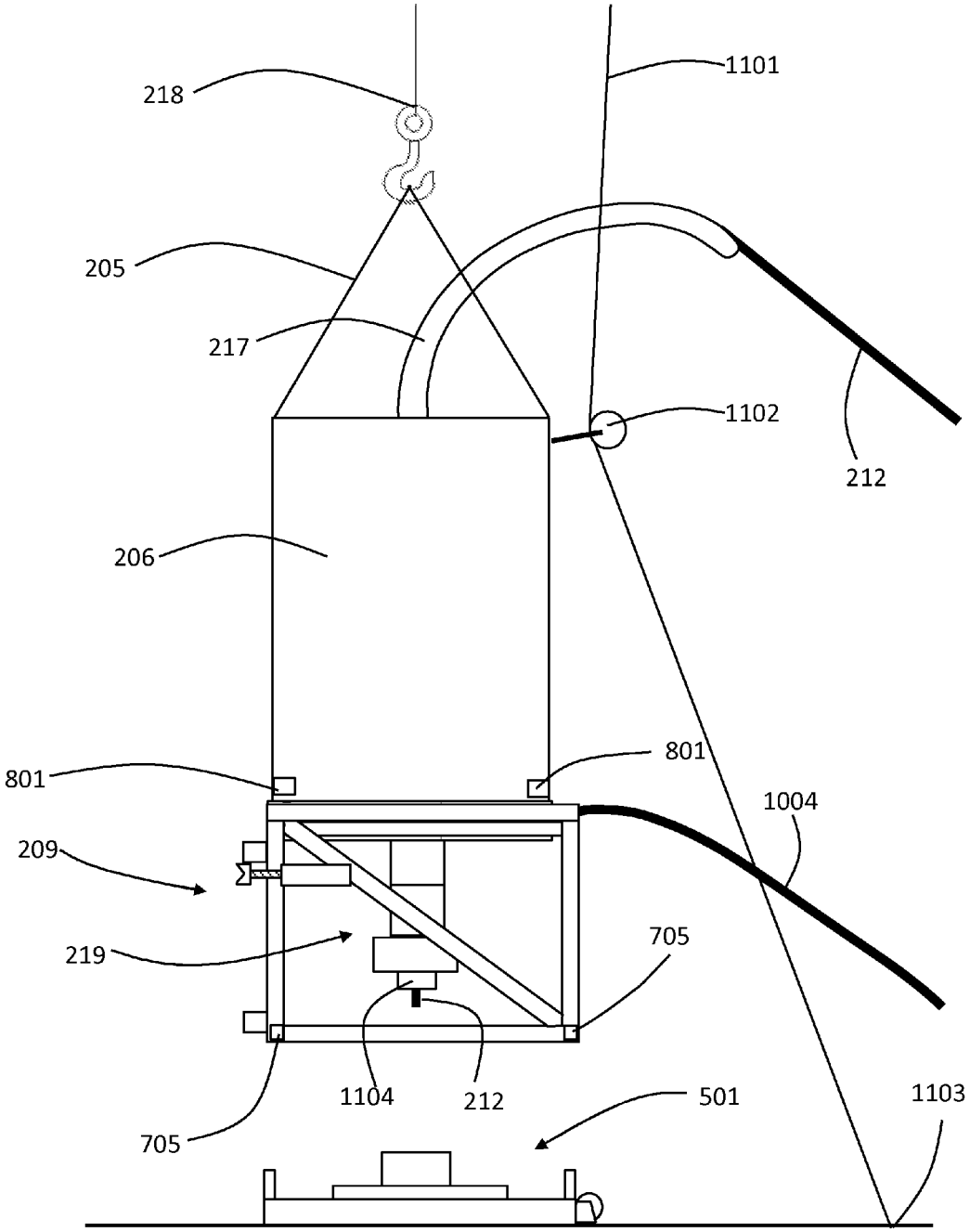

FIG. 11 illustrates the step following the stabbing of the coiled tubing 212 into the injector head 206 and stripper system 219, whereupon the coiled tubing 212 is secured below the stripper system 219 by means of a securement device 1104, further preventing the coiled tubing 212 from exiting through the stripper system 219. A guide system 1101, such as a rig tugger wire is attached to a fixed point 1103, which may be at the rigfloor 101, and to the injector head 206 by means of guide 1102, such as a sheave wheel. The wire and hook 218 extending from the winch 221 (see FIG. 2) is attached to the injector head sling 205. The locking mechanism 705 is disengaged to release the rigid upper frame section 209 from the rigid lower frame section 501, whereupon the injector head 206 and rigid upper frame section 209 is lifted off deck by means of operation of the winch 221, as the load is guided by a mount of tension applied to the rig tugger wire 1101, and the coiled tubing 212 is allowed to follow the lift by manipulation of the coiled tubing reel placed on deck of the floating vessel.

Figure 12:
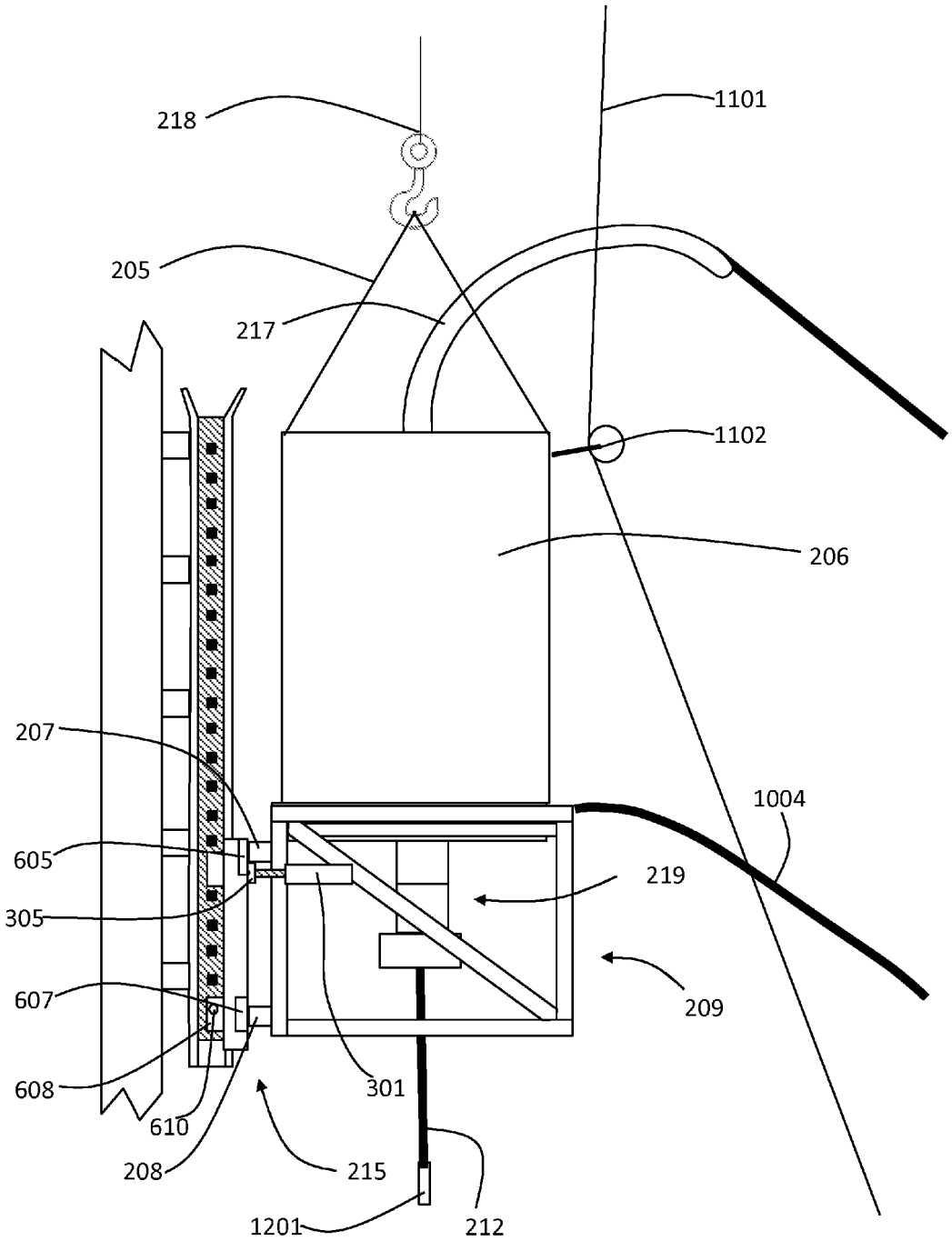

FIG. 12 illustrates the step following lifting the injector head 206 and the rigid upper frame section off deck, where the described load is guided by means of tension applied to the tugger winch wires 1101 as the load is lifted to an elevation similar to the position of the vertical transport system 215, preinstalled onto the rigid guides 203, preinstalled onto the tension legs 204, whereupon the load is landed onto the vertical transport system 215 such that the upper guide system locking mechanism interfaces 605 and lower guide system locking mechanism interfaces 607, engage and secure with the guide system locking mechanisms 207 and 208 part of the rigid upper frame section 209 respectively. The suspension system 301 may be used to accommodate for a dedicated engagement of the opposing members. Typically the vertical transport system 215 is secured to a predefined position by means of activated locking mechanism 610 prior to engaging the rigid upper frame section 209 to the transport system 215. The coiled tubing 212 is extended to the deck of the floating vessel where the securement device 1104 is removed and a coiled tubing end connector 1201 is attached to the end of the coiled tubing 212, whereupon the coiled tubing 212 is retracted such that the end connector 1201 is place near or inside the stripper system 219.

Figure 13:
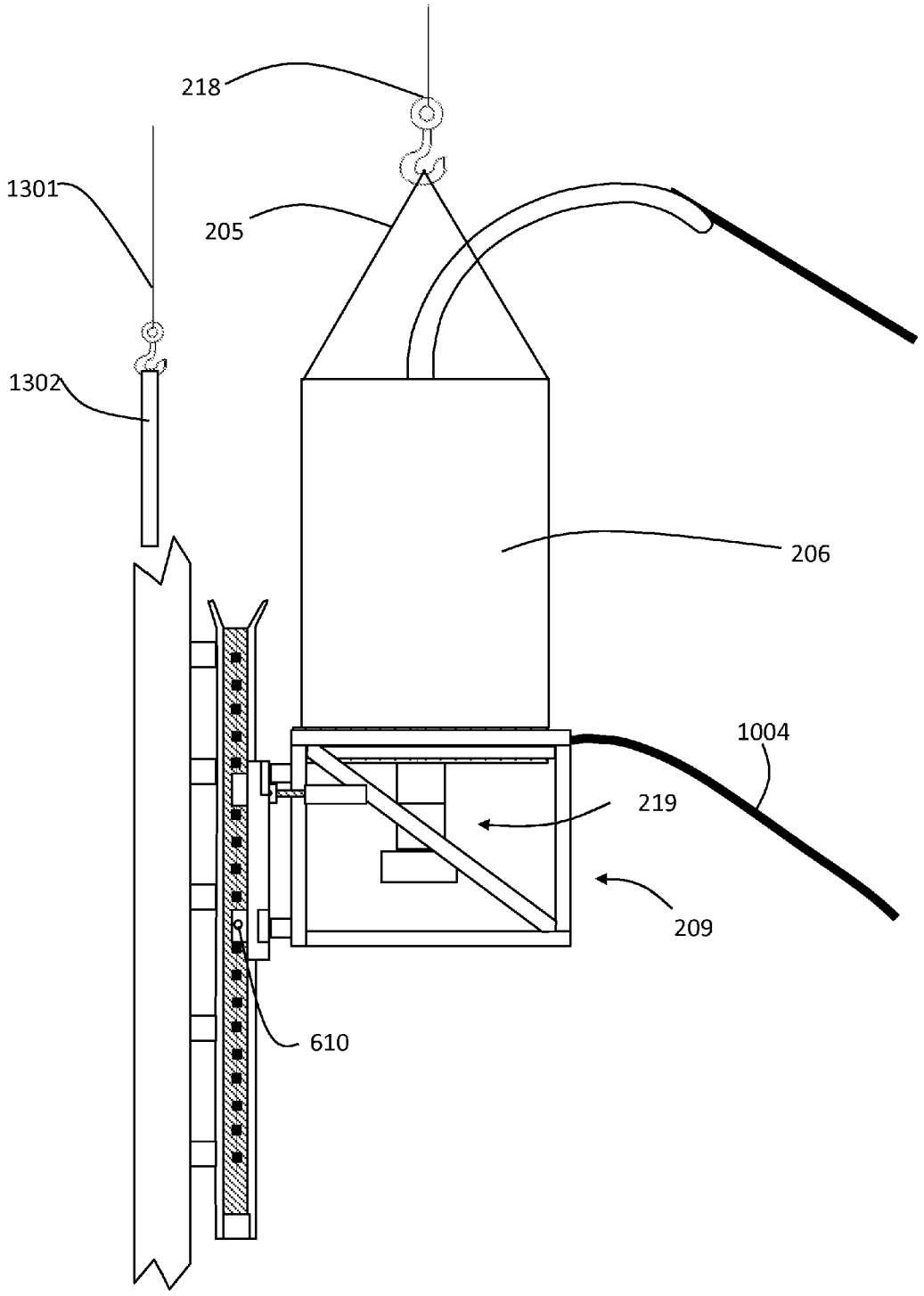

FIG. 13 illustrates the step following the engagement of the rigid upper frame section 209 to the vertical transport system 215, where the locking mechanism 610 is disengaged, whereupon the injector head 206, rigid upper frame section 209, and stripper system 219 is lifted to a new elevated position, by means of operation of winch 221 connected to wire and hook 218, further connected to the injector head sling 205, where locking mechanism 610 is engaged. Tools intended for work in the well 1302, such as sections of bottom hole assemblies are lifted and installed into top of the BOP 210, by use of winch 213 attached to wire and hook 1301, whereupon the bottomhole assembly sections 1302 are secured to the top of the BOP 210 by means of securing devices typically utilized for such operations. In situations requiring more than one section of bottomhole assemblies 1302, a following section is typically connected to the previous section at the top level of the BOP 210, whereupon the new length of bottom hole assembly is lowered into the workover riser 102, whereupon the top of the bottomhole assembly is secured to the top of the BOP 210 by use of devices typically utilized for such operations.

Figure 14:
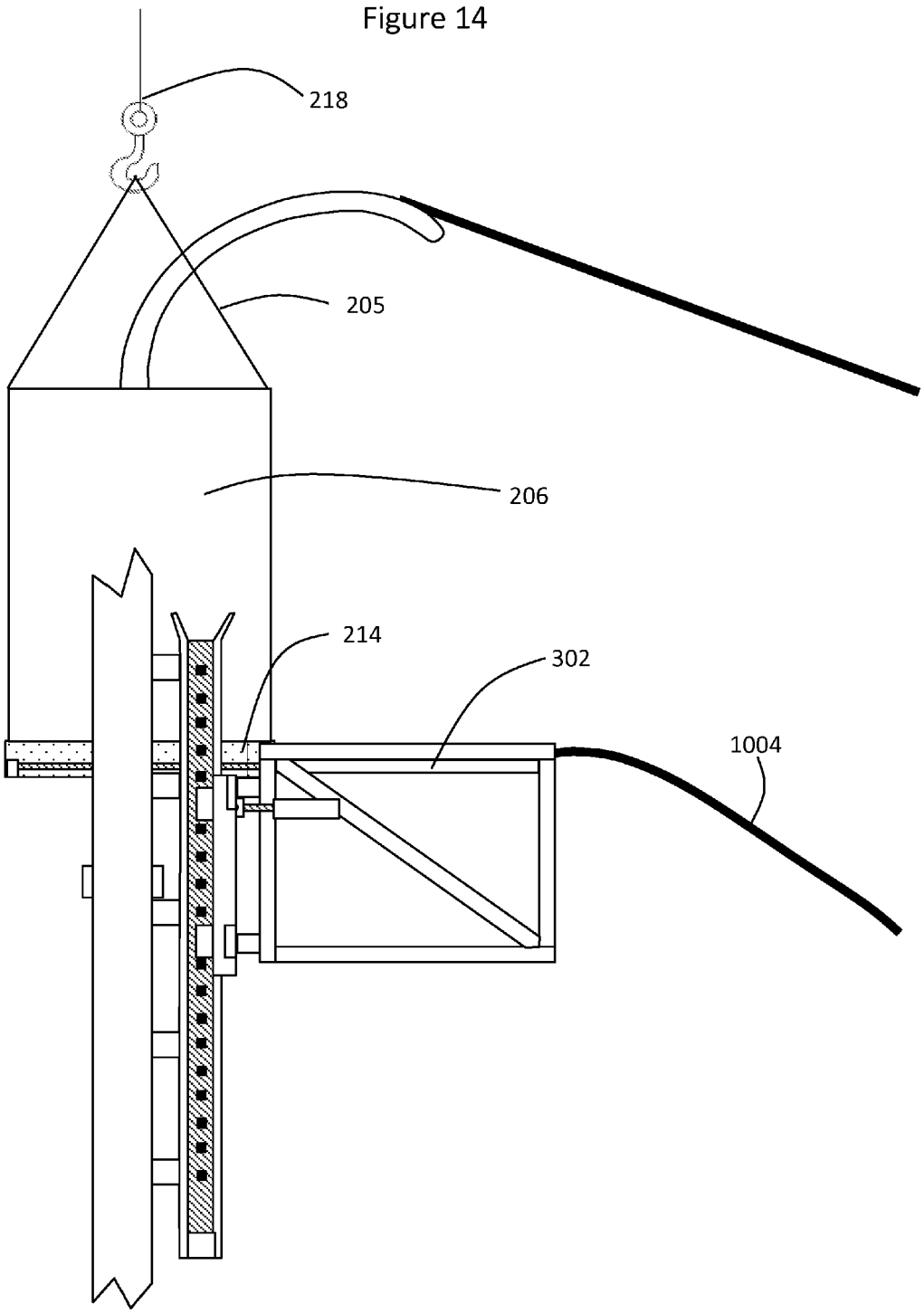

FIG. 14 illustrates the step following installation of sections of bottomhole assemblies 1302 into the BOP 210, where the coiled tubing injector head 206 and stripper system 219 is horizontally displaced such that the center is lined up with the center of the BOP 210, whereupon the coiled tubing 212 is extended lowered towards the top of the bottom hole assembly 1302 and connected thereto by means of the coiled tubing end connector 1201, whereupon the stripper system 219 and coiled tubing injector head 206 are lowered towards the BOP 210, by means of disengaging locking mechanism 610 and operation of winch 221 attached to wire and hook 218 further attached to injector head sling 205, whereupon the quick connection device 701 is connected to an opposing member part of the BOP 210. The system is now installed and an operation in a well may commence.

Figure 15:
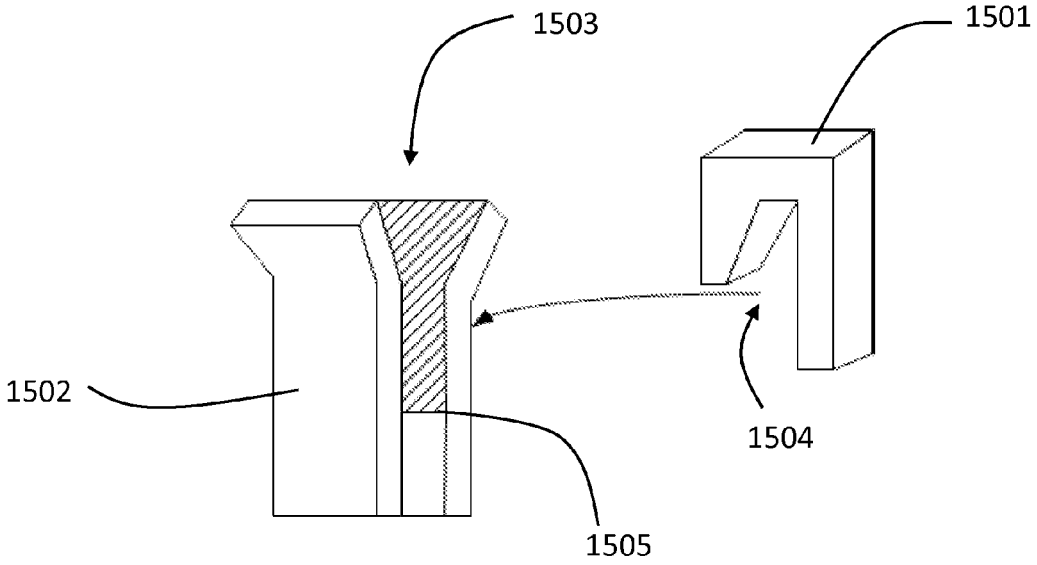
FIG. 15 illustrates an upper guide system locking mechanism.

FIG. 15 illustrates a possible embodiment for the upper guide system locking mechanism interface 605 and guide system locking mechanisms 207. A hook shaped member 1501 is part of the guide system locking mechanism 207 and a slot shaped member 1502 is part of the upper guide system locking mechanism 605, where the hook shaped member 1501 comprise a recess 1504 which is designed to interface with a pocket 1505 part of the slot shaped member 1502, which further comprises a funnel shaped opening 1503 in top to facilitate for easy entry for the hook shaped member 1501, whereupon full engagement the members 1501 and 1502 accommodates for a connection ensuring structural strength and limited movement as defined by requirements to weight and forces related to the equipment, natural environment, and embodiments described herein.

Figure 16:
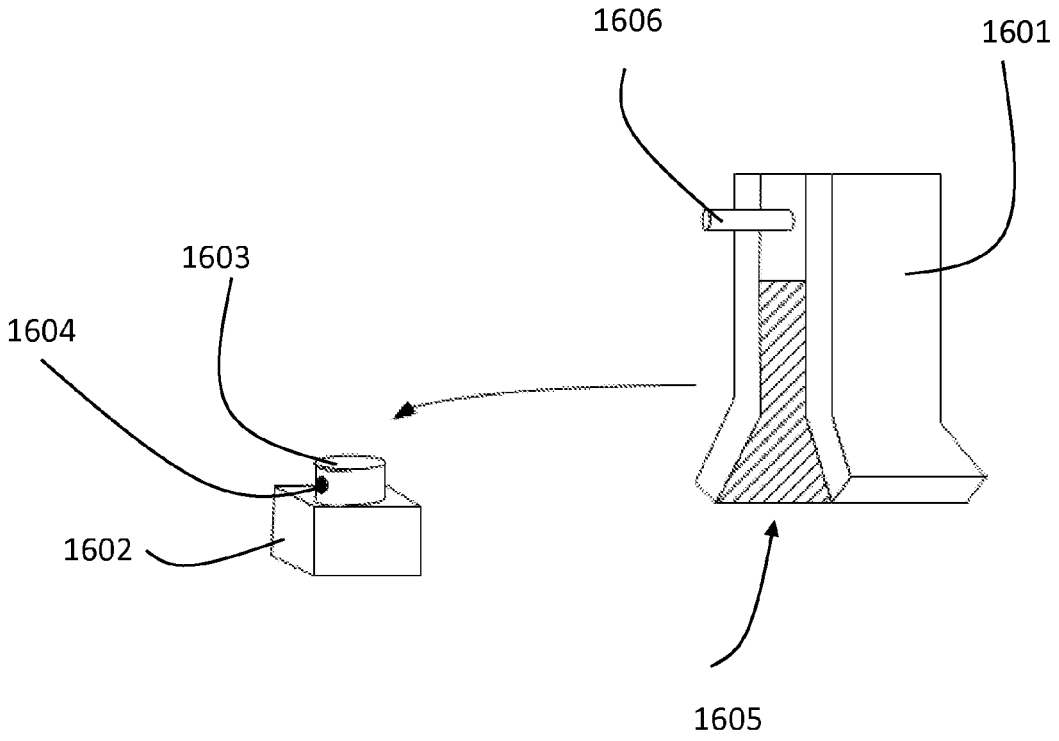
FIG. 16 illustrates a lower guide system locking mechanism.

FIG. 16 illustrates a possible embodiment for the lower guide system locking mechanism interface 607 and guide system locking mechanism 209. A slot shaped member 1601 is part of the guide system locking mechanism 208 and an opposing shaped member 1602 is part of the guide system locking mechanism interface 607, where the opposing shaped member comprises a guide 1603, which further comprises a locking bolt hole 1604. The slot shaped member comprises a funnel shaped opening 1605 in the bottom to facilitate easy entry for the opposing shaped member 1602, and furthermore the slot shaped member comprises a recess shaped in accordance with the guide 1603, which upon engagement may be secured by means of locking mechanism 1606, whereupon full engagement the members 1601 and 1602 accommodate a connection ensuring structural strength and limited movement as defined by requirements to weight and forces related to the equipment, natural environment, and embodiments described herein.

Finally, the descriptions and drawings presented herein only represent examples of embodiments related to the disclosure. Further, any concept, system and method as well as combination(s) of concept(s), system(s) and method(s) described in any text or figure herein could be extended to apply in conjunction or combination with other concepts, systems and methods described in the art. All combinations of concepts, systems and/or methods also comprise part of the objective of the disclosure. All interfacing, combination and utilization with existing equipment, techniques and methods also comprise part of the disclosure.

The invention claimed is:

1. A method of rigging up intervention equipment (111) in a lifting arrangement (104) utilized on a floating vessel, and moving the intervention equipment between an inoperative and an operative position, comprising:

a) providing the lifting arrangement (104) with vertically extending guides (203) capable of transferring a load to the lifting arrangement;

b) connecting the intervention equipment (111) to a load carrying device (209) provided with a transport system (214) configured to horizontally displace a load along a substantially linear path while carried by the load carrying device;

c) moving the intervention equipment from the inoperative position to the operative position by horizontally moving the transport system (214) along the substantially linear path;

d) moving the intervention equipment from the operative position to the inoperative position by horizontally moving the transport system (214) along the substantially linear path;

e) removably attaching a vertical transfer system (215) to the guides (203), the vertical transfer system (215) being attachable and detachable to the guides (203) at more than one vertical position along the guides (203); and f) removably attaching the load carrying device (209) to the vertical transfer system (215) for transporting the load in a vertical direction substantially perpendicular to the substantially linear path of the transport system (214).

2. The method according to claim 1, wherein the vertical transfer system (215) is arranged to be connected to the guides (203) at more than one elevation.

3. The method according to claim 1, wherein the guides are substantially rigid.

4. The method according to claim 1, wherein the guides are substantially rigid.

5. A carrier for bringing an intervention apparatus between an inoperative position and an operative position, the carrier being utilized in a lifting arrangement for operation on a floating vessel, the lifting arrangement being provided with vertically extending guides (203) capable of transferring a load to the lifting arrangement, comprising:

a vertical transfer system (215) removably-attached to the guides (203) to enter into the operative position; and a load carrying device (209) capable of carrying the intervention apparatus, the load carrying device (209) being removably-attached to the vertical transfer system (215) for transporting the load in a vertical direction and to enter into the operative position and provided with a transport system (214) configured to horizontally displace a load along a substantially linear path that is substantially perpendicular to the vertical direction while carried by the load carrying device (209), wherein the vertical transfer system (215) is attachable and detachable to the guides (203) at more than one vertical position along the guides (203).

6. A carrier according to claim 5, wherein the load carrying device (209) is also provided with engagement devices (305) shaped to ensure a dedicated engagement towards the guides (203).

7. A carrier according to claim 5, wherein the load carrying device (209) is arranged to transport a stripper system (219) from one location to another.

8. A carrier according to claim 5, wherein the load carrying device (209) further comprises a pulling device (503).

9. A carrier according to claim 8, wherein the pulling device (503) comprises a coiled tubing stabbing winch.

10. A carrier according to claim 5, wherein the guides are substantially rigid.

11. A carrier according to claim 5, wherein the guides are substantially rigid.

12. A carrier according to claim 5, further comprising system locking mechanisms (207, 208) for detachably connecting the load carrying device (209) to the vertical transfer system (215).

* * * * *